United States Patent [19]

Calmon

[11] 4,056,112

[45] Nov. 1, 1977

[54] CONTAINMENT AND REMOVAL OF RADIOACTIVE SPILLS BY DEPOSITING A CROSSLINKED ION EXCHANGE COMPOSITION IN A DRY FORM OVER REGION OF SPILL

[76] Inventor: Calvin Calmon, Arneys Mount Road, Birmingham, N.J. 08011

[21] Appl. No.: 466,232

[22] Filed: May 2, 1974

[51] Int. Cl.[2] ..... B08B 7/00

[52] U.S. Cl. ..... 134/6; 134/7; 252/301.1 W; 260/2.1 R; 260/2.1 E; 260/2.2 R

[58] Field of Search ..... 260/2.1 R, 2.1 E, 2.2 R; 252/301.1 W; 134/6, 7

[56] References Cited

U.S. PATENT DOCUMENTS

| | | | |
|---|---|---|---|
| 3,047,434 | 7/1962 | Bulat | 134/7 |
| 3,340,200 | 9/1967 | Noble | 252/301.1 W |
| 3,488,219 | 1/1970 | Moroni | 134/6 |
| 3,716,490 | 2/1973 | Van de Voorde | 252/301.1 W |

OTHER PUBLICATIONS

Chemical Abstract, vol. 68, entry 53133f.
Chemical Abstract, vol. 75, entry 83201p.
Chemical Abstract, vol. 71, entry 87210s.
Chemical Abstract, vol. 68, entry 81191s.
Chem. Process Eng., vol. 42, Jan. 1961, pp. 15-19.

*Primary Examiner*—Harry Wong, Jr.
*Assistant Examiner*—Peter F. Kulkosky
*Attorney, Agent, or Firm*—Robert F. O'Connell

[57] ABSTRACT

A new use for ion exchange compositions and a new method for utilizing such compositions in containing and removing spills of radioactive materials. The ion exchange compositions when used with liquid spills are arranged to have a cross-linking which, when they are deposited over the spill, permits them to absorb the liquid spill simultaneously with the occurrence of an exchange of the radioactive ions with the ions of the ion exchange compositions. A dry spill of radioactive material can be contained and removed by using a dampened ion exchange composition which is deposited over the spill. The wet or dry spills can then be readily and safely removed for appropriate disposal.

18 Claims, 1 Drawing Figure

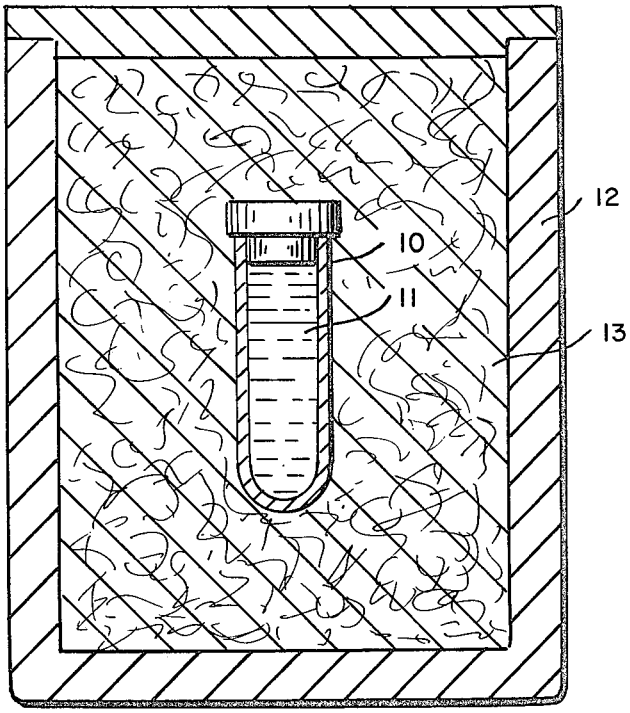
12
10
11
13

CONTAINMENT AND REMOVAL OF RADIOACTIVE SPILLS BY DEPOSITING A CROSSLINKED ION EXCHANGE COMPOSITION IN A DRY FORM OVER REGION OF SPILL

INTRODUCTION

This invention relates generally to the containment and removal of radioactive spills and, more particularly, relates to the use of ion exchange materials for such purposes.

BACKGROUND OF THE INVENTION

To meet the increasing demands for energy throughout the world, the use of nuclear power sources will increase in spite of their potential hazards. The increased expense in using fossil fuels, the monopolistic control of the oil producing nations and the limited availability of other energy sources at the present time and in the foreseeable future will require the use of nuclear energy to assist in supplying the growing needs of countries throughout the world.

Radioactive products, which are used in nuclear power plants and which are formed in nuclear reactors, represent a hazard to man and his environment, since some long-lived nuclides can contaminate areas for thousands of years. They can become deadly to organisms into which they are ingested, even when the dosages are in trace quantities. Moreover, on exposure to the environment the rays emitted by such nuclides can kill organisms very rapidly, even when the latter are exposed for only brief time periods.

The production and transportation of radioactive products over wide areas, the proliferation of nuclear power plants, the presence of service stations for radioactive fuels and areas used for the storage of radioactive wastes all represent a relatively permanent menace to large land areas and populations thereof. While such areas can be centralized to a certain extent so as to avoid heavily populated regions, other installations using radioactive nuclides, such as hospitals, medical and pharmaceutical laboratories, as well as many research facilities using radioactive isotopes in compound form, which may not be conveniently places in locations remote from population centers, also represent potential hazards, particularly where, as in most cases, such facilities do not have specialized personnel to safeguard the handling of the radioactive products in the event of accident.

Accidents have taken place in even the most guarded installations which handle radioactive materials, such accidents being due, for example, to the leakage of stored radioactive liquid wastes from tanks placed above or below ground. At least one chemical explosion, for example, has occurred in one of the shielded cells of a radiochemical processing pilot plant releasing quantities of plutonium-239, zirconium-95 and niobium.

In summary, many sites exist where radiation hazards are present and where spills or leakages can occur, such as at uranium mines and refineries, at facilities for transporting radioactive products, at nuclear power plants utilizing reactors, fuel pools and radioactive waste storage tanks, at isotope purification sites, at laboratories preparing radioactive isotope containing compounds, and at installations using isotope compounds or other radioactive material, i.e., nuclear submarines and ships, nuclear power plants and storage sites for such materials.

DISCUSSION OF THE PRIOR ART

At present many relatively conventional physical methods are used, with or without additional chemical means, for cleaning up radioactive spills such as scrubbing, brushing, sponging, scraping, grinding, abrading, and vacuuming. Such techniques are used, for example, in an attempt to contain and remove the radioactive spill on interior or exterior building surfaces, such as floors, ground surfaces, etc. In addition, the contaminated surfaces of equipment used in radioactive processes, as opposed to such building surfaces, have also been cleaned by the use of certain physical and chemical processes, such as scrubbing with soap or detergents in water, the use of commercial solvents, the use of inorganic salts which may include soluble complexing agents, and the use of caustic compositions or acids such as citric, nitric and hydrochloric acids.

However, no effective physical or chemical means for permitting a relatively rapid containment of radioactive spills so as to prevent the percolation thereof into the ground, the absorption thereof into floors or other furnishings, or the spreading thereof over large surface areas, have as yet been made available. The use of chemical washing and rinse waters for cleaning radionuclides, as in present methods, results in the need for handling huge volumes of liquid which must be appropriately contained, collected and treated before being discharged or stored in tanks and hauled to specific areas for burial or other appropriate disposal.

Accordingly, such methods have proved highly unsatisfactory in providing for relatively quick containment and removal of radioactive spills so that they can be readily and easily disposed of in an appropriate manner.

DESCRIPTION OF THE INVENTION

This invention provides for a relatively rapid containment and removal of radioactive spills by a chemical absorptive means which results in the handling of much smaller volumes of liquid in a much more effective and safer manner than any presently known method.

The invention utilizes ion exchange compositions having cationic groups either in salt or base form, and/or anionic functional groups either in salt or acid form, such materials never having been used up to now for the purpose of containing and removing radioactive spills. Such materials have been used for purifying liquid waste containing particulates and dissolved ionic species, wherein solid ion exchange materials are placed in a purifying tank or column and act as filter and exchange media, the degree of efficiency thereof depending on particle size. In such purifying processes the ion exchange compositions are normally shipped in wet form because the particles in dry form, when wetted, tend to crack or break, in which case such materials cannot be used in purifying column operations due to high head losses as well as possible losses due to backwashing. In all such purification processes the liquid waste which is to be purified must be appropriately contained and brought to the wet ion exchange material which is confined in the tank or column usually fixed in a specific area.

In accordance with the invention, however, ion exchange compositions are used for containing and removing liquid radioactive spills at the site thereof so that, where time for action thereon is limited, no time is lost in trying to pick up and carry the spill to a remote location for purification. In accordance with the invention, for spills of liquid radioactive material, a dry ion exchange resin is used. Such dry ion exchange resins comprise one or more suitable monomers cross-linked with an appropriate cross-linking agent to form a matrix for the ion exchange group or groups as is well-known. In accordance with one aspect of the invention, the cross-linking thereof can be arranged to enhance the liquid absorption characteristics thereof so that, when the ion exchange resin is deposited over the radioactive liquid spill and over the regions surrounding such spill, large volumes of liquid spill are readily absorbed and are effectively confined to the spill region, while the radioactive ionic species becomes simultaneously chemically attached to the exchanger. The ion exchange resin is selected so that its ability to provide an ion exchange with radioactive ions, such as strontium, cesium and plutonium is very high. Thus, the soluble radioactive ions are picked up and held tightly to the solid, dry ion exchanger resin through exchange for non-radioactive species. For example, when using a sodium resin exchanger with strontium-90, the exchange operation can be described as follows:

Sodium Exchanger + Strontium-90 → Strontium-90 Exchanger + Sodium

Because of the desire to avoid handling large volumes of liquid, it is recognized, in accordance with the invention, that it is of the greatest importance in q liquid spill to absorb substantially all the radioactive liquid solution as quickly as possible. Accordingly, the capability of the ion exchange resin to absorb large amounts of such liquid is suitably enhanced. Standard dry ion exchange resins can hold at best 45% to 60% of their total volumes as water. However, this amount of water pickup can be greatly increased if the cross-linking in the ion exchange resin is appropriately arranged. The existence of a relationship between the absorption characteristics of an ion exchange resin and the amount of cross-linking agent that is known, is discussed, for example, in the text "Ion Exchanger Properties and Applications", K. Dorfner, Ann Arbor Science Publishers, Inc. 1972. Such relationship, as determined by the mol percentage of the cross-linking agent used, can be seen from the chart below with respect to an exemplary ion exchange resin material comprising sulfonated copolymers of styrene and a divinylbenzene (DVB) cross-linking agent.

| Mol % DVB in the Ion Exchange Resin | Ratio of the volume of liquid absorbed to the initial dry volume of resin |
|---|---|
| 0.25 | 50 |
| 0.5 | 22 |
| 1.0 | 10 |
| 2.0 | 7 |
| 3.5 | 5 |
| 10 | <2 |

Thus, for example, if 5 gallons of dry ion exchange resin having 0.5 mol % of DVB as a cross-linking agent is used for the absorption of a radioactive spill, approximately 110 gallons of such spill would be so absorbed. For practical applications the cross-linking may range from about 0.25% to about 25%.

While such absorption characteristics of the ion exchange resin are dependent upon the cross-linking therein, the ion exchange capacity of such a resin primarily depends on the dry weight of the resin and is not much affected by the cross-linking thereof.

In order to increase the rate at which absorption of the liquid can be achieved, i.e., to increase the kinetics of the ion exchange operation, the resin can be made in relatively fine sizes so as to increase the surface area thereof. The sizes of said resin particles may lie within a size range from about −16 mesh to about +200 mesh, such particles already being generally presently manufactured and available within a range from about −16 mesh to about +50 mesh. Such particles provide relatively quick absorption action and therefore prevent the percolation or rapid spreading of the radioactive spill. However, resin particles as small as +200 mesh can be used to provide rapid absorption so long as effective methods for retrieving the particles for disposal are used. As can be seen by the above chart the use of a relatively low cross-linking resin together with the use of relatively small particle sizes permits relatively high absorption in comparison to the initial dry volume of the resin so that pickup of the radioactive spill is greatly facilitated.

While the ion exchange materials can be prepared and used in the form of dry particles, as discussed above, they can also be utilized in other forms such as ion exchange cloths which are presently available, a typical cloth being sold by Carborundum Corporation under the designation of "Ion Exchange Cloths and Felts"; ion exchange paper products such as are available from Reeves-Angel Corporation under the designation of "Whatman Ion Exchange Celluloses"; ion exchange products such as are available from Scott Paper Company under the designation of "Industrial Foam Ion Exchangers".

The latter forms have the advantage that they can be relatively easily deposited, by relatively simple equipment or by hand, over the radioactive spill as compared to the use of particulate or powder forms which may require relatively complicated or specially designed equipment for spreading the material over a relatively wide area. Moreover, ion exchange materials in the form of cloth, paper or form can be more easily recovered after it has been used for containing or cleaning the spill, either for reuse through regeneration of the ion exchange material, which regeneration process permits the recovery of the radionuclide materials of the spill which are then contained in the regeneration solution, or for direct disposal at designated areas.

Thus, in accordance with the invention, when a liquid radioactive spill takes place, the dry ion exchange material in one of the forms mentioned above, for example, is suitably deposited over the spill region and over the regions surrounding the spill region, particularly in the direction of flow thereof, so as to absorb the solution and to confine the liquid to the spill area and, thus, prevent its spread or its percolation or absorption into the surface on which the spill has taken place. In this way the ion exchange products act effectively as sponge materials and, in addition, due to the ion exchange operation, permit the radioactive nuclides simultaneously to be held in the ion exchange resin through an ion exchange operation.

Ion exchanger sheets, in cloth, paper or foam forms, can be appropriately deposited at a location where a spill is likely to take place, as a precautionary measure prior to an actual spill, e.g., on trays or in containers used to store or transport radiocative liquids so that spills can be immediately taken care of without the loss of time needed to move the ion exchange material from a storage place to the spill area. Many liquids or dangerous products are shipped in containers which are in turn placed, for example, in cartons containing foamed polymeric products for protection. In accordance with the invention, such foamed products can be arranged to contain ion exchange materials which can absorb both the liquid and the radioactive nuclides in case of breakage of the container with the carton. Such a packaging process makes the transportation of radioactive nuclide solutions much safer than has hitherto been possible.

The matrix of the ion exchange materials can be organic polymers, such organic materials being more capable of providing high liquid absorption characteristics than inorganic ion exchange compositions. Typical organic resins include those of the types sold under the designation Ionac C-240 and A-540 (Ionac Chemical Company); Amberlite IRC-120,IR-938 (Rohm and Haas Co.); Dowex 50 and Retardion (Dow Chemical Co.); Duolite C-10 and A-101 (Diamond Shamrock Co.), although other types are available from the above and other sources. Such organic materials may have a tendency to lose their ion exchange effectiveness or to be destroyed if exposed to relatively high radiation levels. It is not always easy to predict the point at which organic materials will become ineffective since such an effect will primarily depend on the type of radiation involved and the length of time that the resin is in contact therewith, as well as on the type and characteristics of the specific resin used. If the above factors in a particular situation indicate jthat the use of organic resins may not be entirely effective, inorganic ion exchange products less susceptible to destruction at high radiation levels can be utilized. Such inorganic ion exchange materials can include, for example, zeolites, synthetically prepared alumina silicates of crystalline form (i.e., molecular sieves), bentonites, amorphous sodium aluminosilicates and the oxides or phosphates of Groups IV, V and VI.

The process of the invention is also applicable in cleaning up radioactive spills of solid materials, i.e., effectively dry radioactive materials. In such case, the ion exchange compositions, in whatever form available, i.e., particles, paper, foam, etc., are dampened and deposited over the dry spill. While the amount dampened is not necessarily too critical, it is desirable that the material not be so wet as to be unable to retain the moisture that is added for dampening purposes because the excess liquid will tend to flow and be more difficult to contain for easy removal. Accordingly, it is preferable that the material be dampened to a point below the equilibrium water retention point for the particular ion exchange resin which is being used.

The water in the dampened ion exchange material tends to dissolve at least a part of the solid radioactive material of the spill so that the latter is effectively attached to the dampened ion exchange material, partially in solution, the undissolved solids tending to stick to the dampened material and to be held thereby. In either case the radioactive ions of the dissolved and undissolved solids are appropriately in contact with the exchange material so that an ion exchange operation occurs between the radioactive ions and the ion exchange group of the exchanger material and the overall material is suitably contained and can be readily picked up for subsequent regeneration of or other disposal thereof.

The sole FIGURE shows another use of the invention in cleaning up radioactive spills that may occur in a package containing radioactive ions which package may be used, for example, in transporting radioactive materials. As seen therein, a sealed vessel 10 may be used to contain a liquid radioactive material 11, the vessel being enclosed in a housing 12. A liner 13 of foamed material, such as particles, paper or cloth, effectively fills the space between vessel 10 and housing 12, as shown. The foamed paper, cloth or particle materials are impregnated with ion exchange groups, such as a foam material of the type already mentioned. Thus, in the event of a breakage of the interior vessel 10, the radioactive spill which occurs will be effectively absorbed by the ion exchange products, an appropriate ion exchange taking place so that the radioactive ions are safely held therein and cannot escape and produce damaging effects on the environs where the breakage and spill takes place.

What is claimed is:

1. A method of containing and removing spills of liquid radioactive material comprising the steps of depositing an ion exchange composition in a dry form over the region where a spill of liquid radioactive material has occurred and over the regions surrounding said spill region, the amount of cross-linking agent in said ion exchange composition being selected so that the radioactive ions of said radioactive material are exchanged with ions of said ion exchange composition, said radioactive ions being held in said ion exchange composition, and said liquid is simultaneously absorbed by said ion exchange composition and substantially confined to said spill region;

removing said ion exchange composition from said spill region and from said surrounding regions after said ion exchange and said absorption operations have occurred.

2. A method in accordance with claim 1 wherein said ion exchange composition is in the form of dry particles.

3. A method in accordance with claim 2 wherein the sizes of said particles are within a range from about −16 mesh to about +200 mesh.

4. A method in accordance with claim 3 wherein the sizes of said particles are within a range from about −16 to about +50 mesh.

5. A method in accordance with claim 1 wherein said ion exchange composition is in the form of cloth.

6. A method in accordance with claim 1 wherein said ion exchange composition is in the form of paper.

7. A method in accordance with claim 1 wherein said ion exchange composition is in the form of a foam.

8. A method in accordance with claim 1 wherein said ion exchange composition is an organic composition.

9. A method in accordance with claim 1 wherein the cross-linking of said ion exchange composition is between about 0.25% to about 25%.

10. A method in accordance with claim 9 wherein the cross-linking of said ion exchange composition is about 0.25%.

11. A method in accordance with claim 1 wherein said ion exchange composition includes anionic exchange groups.

12. A method in accordance with claim 1 where said ion exchange composition includes cationic exchange groups.

13. A method in accordance with claim 1 and further including the step of regenerating said ion exchange material after said removal so as to recover said radioactive ions.

14. A method in accordance with claim 11 wherein said anionic exchange groups are in salt form.

15. A method in accordance with claim 11 wherein said anionic exchange groups are in acid form.

16. A method in accordance with claim 12 wherein said cationic exchange groups are in salt form.

17. A method in accordance with claim 12 wherein said cationic exchange groups are in base form.

18. A method in accordance with claim 1 wherein said ion exchange composition includes both anionic and cationic exchange groups.

* * * * *